United States Patent [19]

Noyes

[11] Patent Number: 4,702,542

[45] Date of Patent: Oct. 27, 1987

[54] LATCH AND LOCK ELECTRICAL CONNECTOR HOUSING

[75] Inventor: Robert W. Noyes, Framingham, Mass.

[73] Assignee: Honeywell Information Systems Inc., Waltham, Mass.

[21] Appl. No.: 863,203

[22] Filed: May 14, 1986

[51] Int. Cl.[4] ..... H01R 13/627

[52] U.S. Cl. ..... 439/347; 439/465; 439/557; 439/752

[58] Field of Search ..... 339/91 R, 103 M, 103 C, 339/107, 128, 206 R, 210 R, 210 M

[56] References Cited

U.S. PATENT DOCUMENTS

| | | | |
|---|---|---|---|
| 3,824,525 | 7/1974 | Keller | 339/91 R |
| 3,994,555 | 11/1976 | Konno et al. | 339/91 R |
| 4,002,389 | 1/1977 | Mammel | 339/91 R |
| 4,130,330 | 12/1978 | Chandler | 339/91 R |
| 4,341,428 | 7/1982 | Hatch et al. | 339/91 R |
| 4,460,230 | 7/1984 | McKee et al. | 339/106 |
| 4,549,780 | 10/1985 | Bertini et al. | 339/107 |
| 4,575,174 | 3/1986 | Leeds et al. | 339/103 M |
| 4,634,203 | 1/1987 | Noyes | 339/91 R |

FOREIGN PATENT DOCUMENTS

| | | | |
|---|---|---|---|
| 2827272 | 1/1979 | Fed. Rep. of Germany | 339/107 |
| 1196099 | 6/1970 | United Kingdom . | |
| 2042827 | 9/1980 | United Kingdom . | |
| 2088150 | 6/1982 | United Kingdom . | |

*Primary Examiner*—John McQuade

*Attorney, Agent, or Firm*—Faith F. Driscoll; John S. Solakian

[57] ABSTRACT

What is disclosed is a housing for a D-shell connector that comprises two housing parts that snap and lock securely together and can later be separated without the use of tools. In addition, the housing has an integral strain relief cable clamp. Internal or external latching arms capable of latching to more than one connector configuration are easily and quickly combined or charged with the basic connector housing, and one latching arm can simultaneously latch a holding to a mating connector housing and to a cutout in a chassis or panel.

10 Claims, 12 Drawing Figures

LATCH AND LOCK ELECTRICAL CONNECTOR HOUSING

RELATED APPLICATIONS

U.S. patent application of Robert N. Noyes bearing Ser. No. 749,243, filed on June 27, 1985, titled "Universal Internal Latch And Lock D Shell Connector", which issued as U.S. Pat. No. 4,634,203 on Jan. 9, 1987.

BACKGROUND

1. Field Of The Invention

This invention relates generally to electrical connectors, and more particularly to housings for holding electrical connectors to facilitate connecting and disconnecting the connectors.

2. Background Of The Prior Art

In the prior art there are many types of electrical connectors and many types of connector housings to contain and protect the connectors. Typically, such connector housings are fastened together with adhesives, screws, clips, or other fastening means. The connector housings have a cable inlet opening by which the wires of a cable enter the connector housing and are connected to wiring terminals of a connector therein. The male or female mating terminals of such connectors protrude from the interior of an assembled connector housing to facilitate connecting a male connector within one connector housing to a female connector within another connector housing.

In the prior art, some connector housings have latching means that are used to securely latch a connector housing containing a first connector with either another connector housing containing mating connector, or to a chassis or panel to which a mating connector is fastened. Examples of prior art latching means are found in U.S. Pat. Nos. 3,824,525 and 4,575,174, published U.K. Patent application Nos. 2,042,827, and 2,088,150 and U.K. Pat. No. 1,196,099. The latching means help prevent mated connectors from inadvertently disconnecting due to factors such as vibration or a cable being accidentally pulled. Examples of such prior art latching means are screws and nuts, wire straps, and flexible latching arms that are either molded as a part of the connector housing or are attached thereto. However, these prior art connector housings and fastening means have limited applications and require tools to assemble and disassemble them.

Thus, there is a need in the art for an electrical connector housing that may lie quickly and easily assembled and disassembled without the need for tools, that may latch with other connector housings or latch to chassis or panel mounted connectors or to a panel and still allow another connector housing to be latched to it, or that may latch to industry standard iso-blocks. And, when it is required to latch the connector housing to other than standard latching arrangements, there is a need that the latching arms may quickly and easily be changed without the need for tools.

SUMMARY OF THE INVENTION

The above and other needs of the prior art are satisfied by the preferred embodiment of the present invention. An inexpensive, molded, electrical connector housing consisting of two halves that may be identical is provided. Each housing half has mating locking elements needing no tools to assemble or disassemble the connector housing halves, to assemble the housing with a connector and cable, or to later change connector wiring or the connector itself. In addition, separate flexible latching arms are mounted to the connector housing of the present invention with protrusions that aid in holding the housing halves together. The latch arms are configured to adapt the latching arms to more than one latching arrangement. The latching arms may quickly and easily be changed without special tools when necessary so that latching may be provided with connector housings having different latching means from many different manufacturers. In this sense, the latch and lock electrical connector housing of the present invention is a universal connector housing.

BRIEF DESCRIPTION OF THE DRAWINGS

The present invention will be better understood upon reading the following Detailed Description in conjunction with the drawings in which.

DETAILED DESCRIPTION OF THE INVENTION

Figure 1:
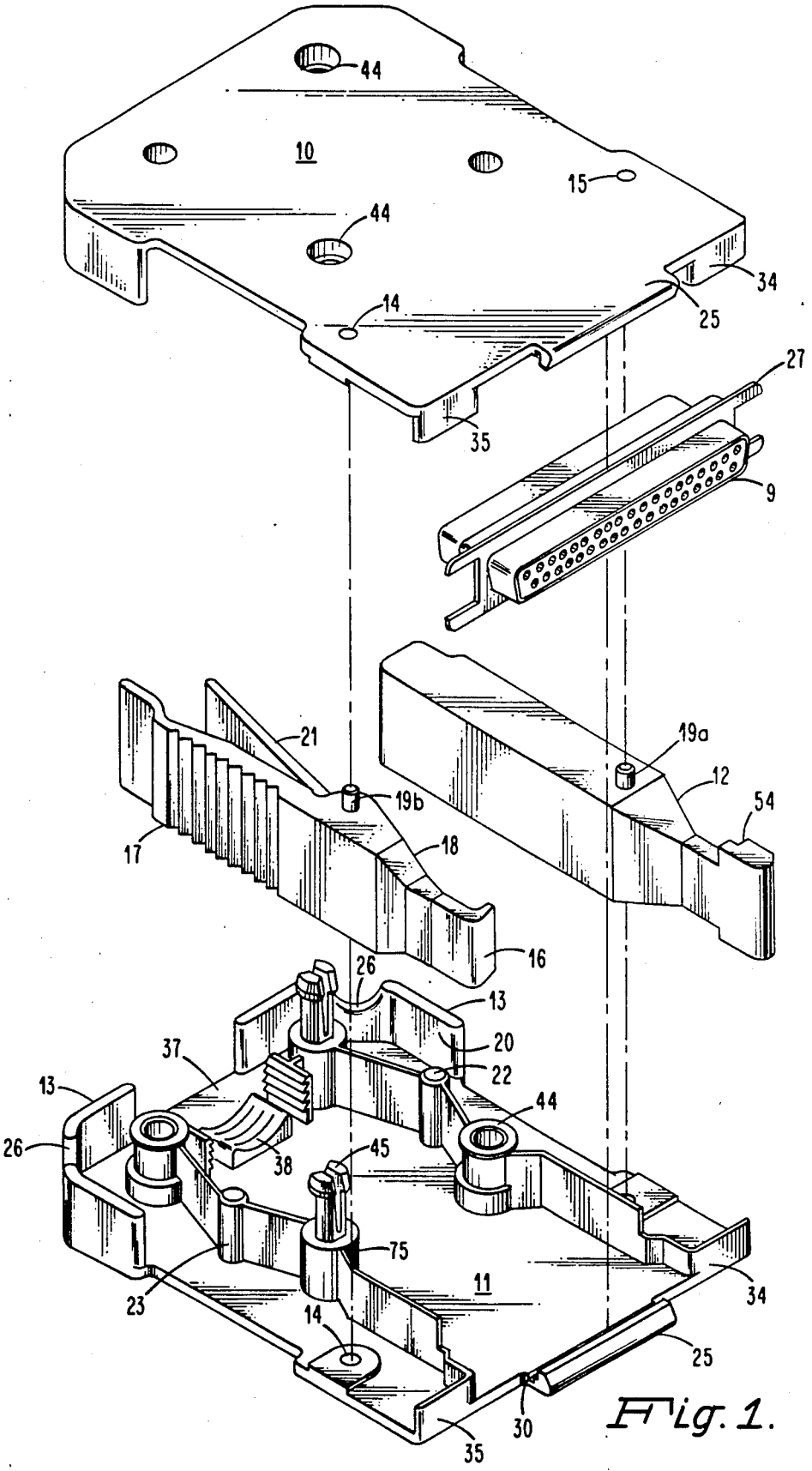
FIG. 1 is an exploded three-dimensional drawing showing an electrical connector housing, without a connector, constructed in accordance with the teachings of the present invention.
Figure 7:
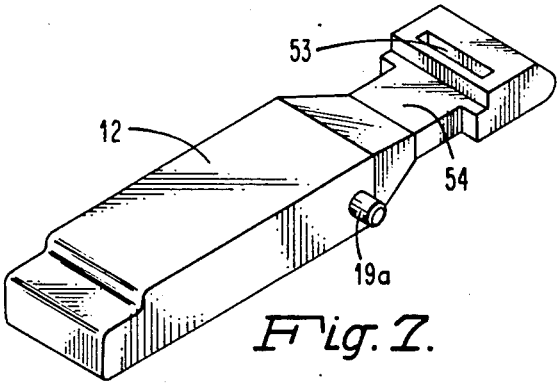
FIG. 7 is a partial three-dimensional view of an internal latching arm that is part of one configuration of the connector housing, and that permits mounting to both a panel and to an external latching arm of a mating connector housing.

FIG. 1 is an exploded three-dimensional view showing a latch and locking electrical connector housing in accordance with the present invention. This electrical connector housing is designed to hold standard D shell connectors. The connector housing comprises a top piece 10 and a bottom piece 11 which are preferably molded out of filled polyvinyl chloride, but may also be made out of other materials such as ABS material, Nylon or Delrin material. The lower housing piece 11 shown in FIG. 1 shows the interior details of the housing. A connector 9 is also shown, the flange 27 of which is held by groove 30 in extended portions 25 of both housing halves 10 and 11. An assembled connector housing also comprises a pair of internal latching arms 12 or, alternatively, a pair of external latching arms 18. One of each pair of the arms 12 and 18 are shown in FIG. 1 for illustration purposes only. Details of latching arms 12 are shown in FIG. 7, and the interior side of housing pieces 10 and 11 are also shown in FIG. 2, all of which are described hereinbelow.

Two latching arms 12 are assembled to connector housing pieces 10 and 11 using protrusions 19*a* on the top and bottom of arms 12 and. On assembly of the connector housing, protrusions 19*a*, of arms 12 extend into holes 14 and 15 of housing pieces 10 and 11, and arms 12 are thereby rotatably held in the assembled connector housing. The two protrusions 19*b* of external latching arms 18 capture two arms 18 between assembled housing halves 10 and 11 and also allow latching arms 18 to pivot about their protrusions 19*b* to allow latching and unlatching of the mated connector housings. This operation is described in greater detail further in this specification. Both external latching arms 18 and internal latching arms 12 are preferably molded of a plastic material that sells under the brand name of "Valox", but one skilled in the art can select and use other plastic materials.

A major advantage of the present invention is that the connector housing may be quickly and easily assembled or disassembled without tools. Thus, the connector wiring and the latching arms may be quickly and easily changed without tools. This feature greatly enhances the usefulness of the connector housing as taught herein. Further details regarding latching arms 12 and 18 are described further in this specification with reference to FIG. 2, 7 and 8.

Figure 2A:
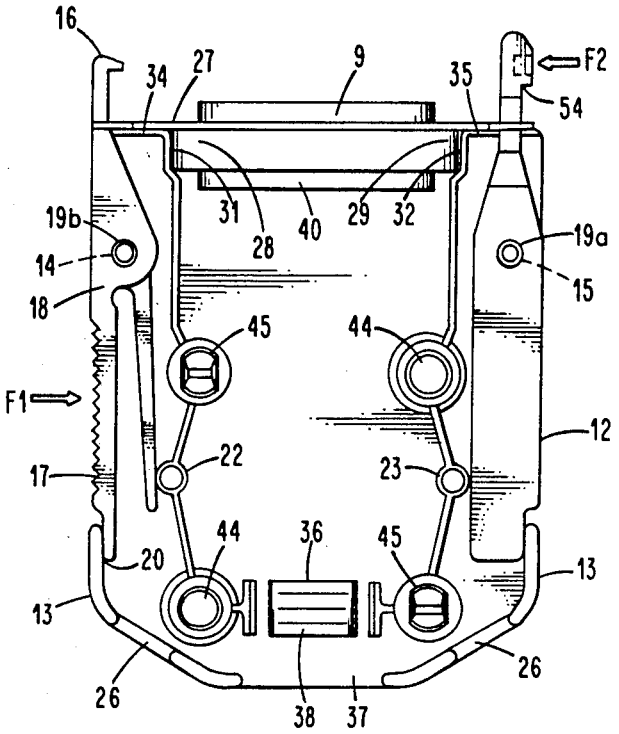
FIG. 2*a* is a top view showing the interior and parts of the electrical connector housing incorporating a strain relief member of FIG. 3 constructed in accordance with the teaching of the present invention.

In FIG. 2*a* is shown a view showing the orientation of parts and details of the interior of the novel electrical connector housing halves 10 and 11. While the two types of mating latching arms 12 and 18 are shown in FIG. 2*a*, in reality two of either one of them are assembled with a complete connector housing. As mentioned with reference to FIG. 1, one of the arms is shown only for illustration purposes. During assembly, the aforementioned protrusions 19*a* of two identical latching arms are first inserted into holes 14 and 15 of one of housing pieces 10 or 11. Protrusions 19*a* and 19*b* are long enough that they extend into holes 14 and 15 a distance equal to the thickness of connector housing pieces 10 or 11 at the location of the holes. Similarly, the last step of assembly of a connector housing is to assemble the other housing piece by inserting 19*a* and 19*b* protrusions into holes 14 and 15.

Figure 2B:
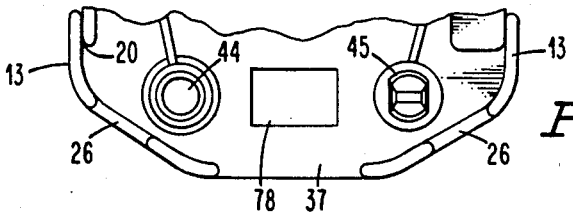
FIG. 2*b* is a partial top view of the housing of FIG. 2*a* constructed to use the separate strain relief member of FIG. 11.
Figure 8:
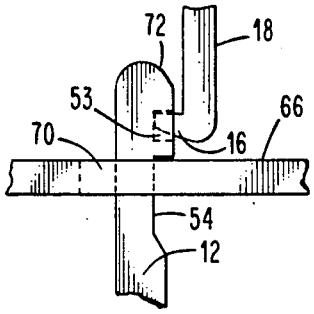
FIG. 8 is a partial view of two latching arms on mating connector housings in a latched position and also shows one of the latching arms simultaneously latched to a panel.

Latching arm 18 has a flexible extension 21 as shown in FIG. 2*b*. When an arm 18 is assembled to housing pieces 10 and 11, extension 21 is used to provide spring action for latching arm 18 so that it can latch and unlatch with arm 12 as shown in FIG. 8. When a pair of latching arms 18 are assembled to connector housing piece 10 in FIG. 2*a*, protrusions 19 are in holes 14 and 15 and flexible extension 21 of each arm is respectively in contact with protrusions 22 and 23 within housing member 10. The application of a force F1 at the point indicated in FIG. 2*a* pivots latching arms 28 counter clockwise around hole 14 and clockwise around hole 15 to thereby accomplish unlatching from mating latching arms 12 on a separate connector housing. The latching of arms 12 and 18 are shown in FIG. 8. The application of force F1 to latching arms 18 at the point indicated in FIG. 2*a* deflects their flexible extensions 21 and thereby creates a spring force that returns arms 12 to their original position when unlatching has been accomplished and force F1 is removed. In the relaxed state, ends 17 of latching arms 18 rest against the inside of wall 13 at location 20.

When a connector housing equipped with latching arms 18 is pushed into a locking engagement with another connector housing equipped with latching arms 12, as shown in detail in FIG. 8, the sloped end of hook 16 on the end of arm 18 engages the sloped surface 72 on the end of arm 12, and as the housings are pushed together a force is created between the two which deflects arm 18 against its flexible extension 21. As the connector housings fully engage the hook end 16 of latching arm 18 snaps into depression 53 in the end of latching arm 12. This snap into place locking action takes place without having to apply a force to arm 17 of latching arm 18.

As shown in FIG. 2*a*, on connector housing piece 10 (and also on housing piece 11, not shown) are channels and surfaces that captivate electrical connector 9 when pieces 10 and 11 are assembled together. When assembled, the edge of flange 27 on electrical connector 9 is contained in channel 30 on extensions 25 of housing pieces 10 and 11 that are shown in FIG. 1. Surfaces 28 and 29 at the ends of connector 9 respectively touch and are contained by housing surfaces 31 and 32. The bottom side of the ends of connector flange 27 sit on the housing surfaces 34 and 35 of both connector housing pieces 10 and 11. In this manner connector 9 is securely held within an assembled connector housing.

Figure 3:
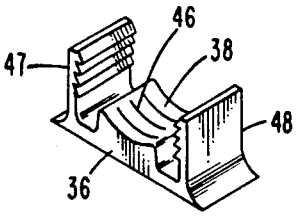
FIG. 3 is a three-dimensional view of part of a strain relief member molded inside the electrical connector housing.

Molded as part of connector housing piece 10 in FIG. 2*a*, and also as part of identical connector housing piece 11, in one embodiment of the invention is a cable clamping strain relief member 36 which is shown in detail in FIG. 3. A cable (not shown) to which an electrical connector 9 is attached enters the connector housing at opening 37, and the cable insulation lies on a curved surface 38. A locking strain relief member 39 (not shown in FIG. 1, but shown in detail in FIG. 4) is then locked together with strain relief member 36 to securely hold the cable in connector housing piece 10. From the captivated end of the cable locked between strain relief members 36 and 39, the wires within the cable fan out and are connected to terminals (not shown) on the rear 40 of connector 9 in a manner well known in the art. Details of strain relief members 36 and 39 are described in greater detail in this specification with reference to FIGS. 3 and 4. Cables ranging between three-sixteenths inch diameter and one-half inch diameter may be securely and safely held between strain relief and locking members 36 and 39.

Figure 6:
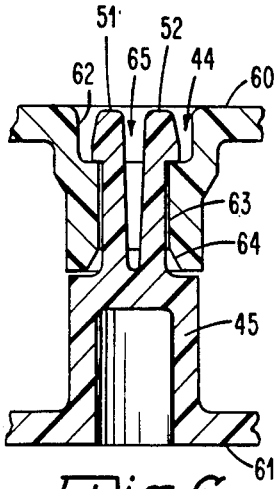
FIG. 6 is a view of a molded projection on one connector housing part in a locked engagement in a hole in a mating connector housing part.

During the molding of both connector housing pieces 10 and 11 two holes 44 are molded therein as shown in FIG. 2*a*. Holes 44 go through to the outside of connector housing pieces 10 and 11. Details of the holes 44 are shown in FIG. 6 and are described in detail in connection therewith. Also molded into the inner area of both connector housing pieces 10 and 11 are two projections 45 as generally shown in FIG. 2a. Projections 45 are shown in detail in FIGS. 5 and 6 and are described in detail with reference to these figures. Holes 44 and projections 45 are positioned on connector housing pieces 10 and 11 such that when housing piece 10 is assembled with housing piece 11 and a pair of latching arms 12 or 18 to make up a complete connector housing, projections 45 fit into holes 44 and lock therein to thereby lock the connector housing closed without the need for any other fastening means. Further details of how projections 45 lock into holes 44 are shown in FIG. 6 and are described with reference thereto.

In FIG. 2a it can be seen that connector housing piece 10 has walls 13 around parts of its rear and on which surfaces 20 are located. Through walls 13 there are two semi-circular cutouts 26. Housing piece 11 has the same cutouts 26, and when housing pieces 10 and 11 are locked together the cutouts 26 on each form two holes through the rear of the assembled connector housing. The purpose of these holes in the rear of the assembled housing is to permit use of the connector housing without latching arms 12 or 18. Latching screws are inserted through the two holes formed by cutouts 26, as shown in both FIGS. 1 and 2a, and screw into a threaded nut on a matingn prior art connector. The tip and shank of a screw driver can also pass through the holes formed by cutouts 26 in the rear of an assembled housing to facilitate inserting and turning the screws to fasten mating connectors together.

In FIG. 3 is shown a three dimensional blow-up of the strain relief member 36 which is molded as part of connector housing piece 10 in the position shown in FIG. 2a for one embodiment of the invention. Strain relief member 36 has a curved surface 38 in which the curved outer surface of a cable (not shown) entering connector housing 10 lays. Molded as part of curved surface 38 are a number of raised beads 46 that help hold the cable in the connector housing 10 after locking strain relief member 39 is joined therewith as described hereinafter. Strain relief member 36 also has side walls 47 and 48 that have a number of saw-tooth shaped protrusions molded therein as shown. These saw-tooth protrusions lock with locking strain relief member 39, shown in FIG. 4 and described herein, and permit cables from three-sixteenths inch to one-half inch diameter to be securely held between strain relief and locking members 36 and 39.

Figure 4:
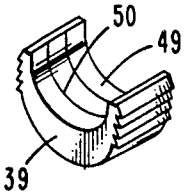
FIG. 4 is a three-dimensional view of a separate locking piece that cooperates with the strain relief member.

In FIG. 4 is shown a locking strain relief member 39 which is molded separately from connector housing pieces 10 and 11. Locking strain relief member 39 also has a curved surface 49 that has the same radius of curvature as curved surface 38 of strain relief member 36 in FIG. 3. Curved surface 49 also has a number of raised beads 50 molded therein, and also has saw-tooth shaped protrusions molded as part thereof as shown. The distance between the two sets of saw-tooth protrusions on strain relief member 39 is the same as the distance between the sets of saw-tooth protrusions on side walls 47 and 48 of locking strain relief member 36 in FIG. 3. In assembly, locking strain relief member 39 is inverted from the position shown in FIG. 4 and is pushed down between the side walls 47 and 48 of strain relief member 36. Due to the physical dimensions of strain relief members 36 and 39, walls 47 and 48 bow outward as the saw-tooth protrusions of both strain relief members 36 and 39 ratchet together. With a cable initially placed on curved surface 38 of strain relief member 36, locking strain relief member 39 is pushed down as far as possible to thereby lock the cable between strain relief members 36 and 39. If it is ever desired to disengage locking strain relief member 39 from member 36 and release the cable held firmly between them, a force is applied outward to the top of walls 47 and 48 to thereby let the saw-tooth teeth disengage. Strain relief members 36 and 39 can also hold cables having different cross sectional areas as well as the size range identified above.

Figure 5:
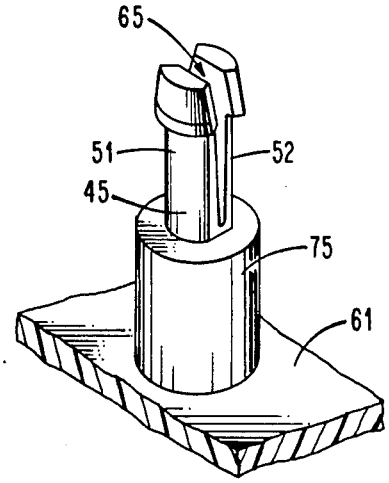
FIG. 5 is a three-dimensional view of projections molded inside the electrical connector housing and used to lock the housing parts together without the use of tools.

In FIG. 5 is shown in detail one of the two projections 45 that are molded as a part of connector housing pieces 10 and 11 as generally described above with reference to FIG. 2a, and also seen in FIG. 1. It can be seen that protrusions 45 are molded as part of and on top of pedestals 75 inside housing pieces 10 and 11. The top of a protrusion 45 is bulbous and has a relaxed diameter larger than a smaller diameter portion of a hole 44 also molded into connector housing pieces 10 and 11. There is a slot 65 down through protrusion 45 creating sides 51 and 52. As protrusion 45 is inserted into a hole 44, sides 51 and 52 bow inward so that the bulbous portion of protrusion 45 can pass through the smaller diameter portion 63 of hole 44 until they reach a larger diameter portion 62 of hole 44.

In FIG. 6 is shown a side view of a protrusion 45 inserted and locked into a hole 44. Surfaces 60 and 61 are the outside surfaces of a pair of housing pieces 10 and 11 which are locked together by protrusions 45 in holes 44 as shown. Each hole 44 has a larger diameter portion 62 and a smaller diameter portion 63. On the inside of the housing pieces the entrance to the smaller diameter portion 63 of hole 44 has a flared portion 64 which facilitates inserting the bulbous portion of protrusion 45 therein. As protrusion 45 is inserted into and passes through hole portion 63, its sides 51 and 52 bow inward into its slot 65. As the bulbous portion of protrusion 45 passes into the larger diameter hole portion 62, sides 51 and 52 expand to their original position shown in FIG. 6. Because of the flat bottom surface of the bulbous portion, protrusion 45 is prevented from being removed from hole 44 and thereby locks housing pieces 10 and 11 together in a locked mated position. To open a locked connector housing, sides 51 and 52 of each protrusion 45 must be depressed inward toward their slot 65 until the bulbous portion can pass into the smaller diameter portion 63 of hole 44. Then housing pieces 10 and 11 may be pulled apart.

In FIG. 7 is shown the latching end of an internal latching arm 12. The protrusions 19a of which only one is shown, fit in opposing holes 14 or 15 in housing pieces 10 and 11 as previously described. This construction permits latching arms 12 and 18 to be assembled into the connector housing without the need for tools as previously described. At the end of latching arm 12 is a detent 53 and a channel 54. Detent 53 is used to latch a hook end 16 on mating arms 18 of another connector housing, while channel is used to simultaneously latch an associated connector housing to a panel 66. This feature of the invention is described in greater detail hereinafter with reference to FIG. 8.

In FIG. 8 is shown only the latching ends of two mated latching arms 12 and 18 which are shown in their entirety in FIGS. 1 and 2a. Latching arm 18 has a hook end 16 that catches in detent 53 molded into the end of latching arm 12 as shown in FIG. 8. To remove hook end 16 from detent 53, force F1 is applied to latching arms 18 as shown in FIG. 2a to pivot hook ends 16 of arms 18 away from detents 53. There is also a channel 54 on the end of latching arm 12. When a first connector housing is to be fastened to a panel 66 and a second mating connector housing, the first connector housing is equipped with internal latching arms 12. To latch the first connector housing to panel 66, the ends of the two latching arms 12 each pass through a cutout 70 through the chassis or plate 66 and detent 54 catches the edge of the cutout to latch the first connector housing thereto. To engage or disengage latching arms 12 from chassis cutout 70, a force F2 is applied to latching arm 12 as shown in FIG. 2*a*. This force F2 deforms arm 12 to move channel 54 away from the edge of panel 66, and arm 12 can then be removed from cutout 70 through chassis or plate 66. When latching arm 12 is being latched to cutout 70 through a panel 66, sloped surface 72 on the end of the arm helps arm 12 to bend so that it passes through the cutout. When channel 54 is in line with chassis 66, arm 12 moves to its normal position as shown in FIG. 8 and is thereby latched to panel 66 as shown in FIG. 8.

The ability of a connector housing equipped with latching arms, such as latching arms 12, to simultaneously latch to both a panel 66 and to latching arms 18 on a mating connector housing, as shown in FIG. 8, is taught in related U.S. patent application Ser. No. 749,243, entitled "Universal Internal Latch And Lock D Shell Connector".

Figure 9:
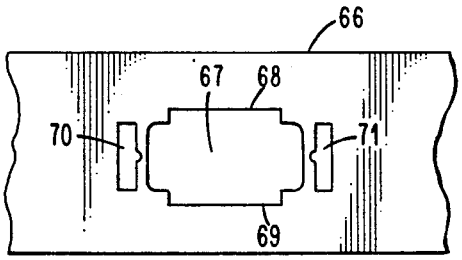
FIG. 9 shows a three part cutout through a panel into which a connector by itself may be fastened, or to which a connector in the connector housing may be latched.

In FIG. 9 is shown panel 66 which includes a three part cutout. The middle portion 67 is the part in which a D type connector can be mounted by itself. In addition, there is an extended cutout portion 68 and 69 at either side of middle portion 67. These allow a connector in the connector housing taught herein to be mounted to panel 66. Cutouts 68 and 69 provide space for connector housing extensions 25 (shown in FIGS. 1 and 2*a*) to pass through plate 66. There are also end cutout portions 70 and 71 used to latch the connector housing with latching arms 12 to plate 66 as shown in FIG. 8. Cutout portions 70 and 71 each include a small semi-circular portion as shown which provides for clearance room for mounting and functioning with prior art connectors utilizing screw latching means in a manner well known in the art, and also described above with reference to semi-circular cutouts 26 shown in FIG. 2*a*.

Figure 10:
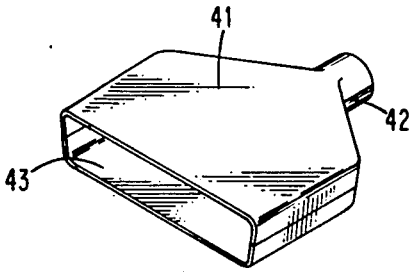
FIG. 10 is a three-dimensional view of a prior conductive shield that may be added inside the electrical connector housing of FIG. 1 to provide EMI and RFI suppression.

In applications of the connector housing of the present invention where radio frequency interference (RFI), electromagnetic interference (EMI), and/or electrostatic discharge (ESD) are to be suppressed, a commercially available conductive shield 41 shown in FIG. 10 may be added inside the connector housing. Conductive shield 41 has a general funnel shape. Opening 42 at the bottom of shield 41 is typically round and matches the diameter of the cable, and opening 43 at the top of shield 41 is rectangular with rounded corners. The shape of opening 43 is the same as that of the portion of connector 9 bounded by surfaces, including surfaces 28 and 29 just below flange 27 of connector 9 as shown in FIG. 2*a*. On assembly the wires of the cable (not shown) pass through shield 41 and are soldered to the terminals (not shown) on the rear 40 of connector 9, also as shown in FIG. 2*a*. Opening 43 of shield 41 is then slid over surfaces 28 and 29 of connector 9 to make an interference fit and electrical connection therewith, and a braided shield around the cable (not shown) is soldered or otherwise connected to shield 41 at opening 42 in a manner well known in the art. The assembled connector 9, shield 41, and cable are then placed in connector housing piece 10, locking strain relief member 39 is installed to clamp the cable, and the mating connector housing piece 11 is then latched therewith along with the latching arms 12 and 18 to complete the connector housing.

Figure 11:
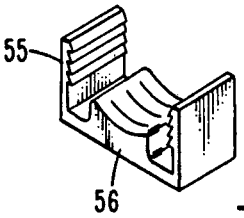
FIG. 11 is a three-dimensional view of a separate strain relief member that may be added to the electrical connector housing of the present invention.

FIG. 11 shows an alternate embodiment of strain relief member 36 shown in FIG. 3. This alternate embodiment of the strain relief member is not molded as part of the connector housing halves 10, but is otherwise identical. Rather, it is a separate piece as shown in FIG. 11. The advantage of a separate strain relief member 55 is that there is no need for different connector housing pieces 10 and 11. Rather, they are identical as shown in FIG. 2*b*. As shown in FIG. 2*b*, there is just a recess 78 in the surface of connector housing pieces 10 and 11 where strain relief member 55 is captivated between two assembled housing pieces 10 and 11. The bottom and top corner dimensions of strain relief member 55 are the same as the recess in which they fit. The strain relief member 55 is clamped onto a cable using strain relief member 39 as previously described, and the combination is then placed in the aforementioned recess 78 in both connector housing pieces 10 and 11 when they are assembled together. This captivates the combined locked strain relief members 55 and 39 so that strain relief is provided to the cable.

While what has been described hereinabove is the preferred embodiment of the invention, it will be obvious to those skilled in the art that numerous changes may be made therein without departing from the spirit and scope of the invention.

For example, even though only latching arms 12 and 18 are disclosed in this specification, other design latching arms may quickly and easily be combined with the novel connector housing to latch with other types of connector housings that are most likely not standard in the connector industry. Further, rather than use protrusions 19*a* and 19*b* on latching arms 12 and 18, a hole can go through latching arms 12 and 13 at the position of protrusions 19*a* and 19*b*. On assembly a roll pin would be inserted through the aligned holes 14 and 15 and the hole through the latching arms. Further, to provide EMI protection and RFI suppression without the use of a shield 41, such as shown in FIG. 10, the inside of housing pieces 10 and 11 may be plated with a thin layer of a conductive material such as aluminum. Alternatively, the plated conductive layer may be replaced with a conductive paint coating, or a powdered conductive material may be mixed in the plastic material from which the housing pieces are molded.

What is claimed as the invention is:

1. A housing for holding an electrical connector so that said connector and said housing may mate and latch with another connector held in another housing, said housing comprising:

first and second housing halves, each half including means for receiving said connector, said first and said second housing halves each having a plurality of projections in predetermined positions, and a plurality of first and second holes in predetermined positions;

said predetermined positions of said first holes and said projections being located such that when said housing halves are mated together to hold said connector between said receiving means of said halves of an assembled housing, said projections of said first housing half are inserted into said first holes of said second housing half, and said projections of said second housing half are inserted into said first holes of said first housing half locking said first and second housing halves securely together, and each of said second holes in said first housing being coaxially aligned with a corresponding one of said second holes in said second housing half when both said housing valves are mated together to assembly said housing; and a number of latching arms, each latching arm being associated with a different pair of said coaxially aligned second holes, each of said latching arms having two opposed coaxial protrusions, said protrusions being inserted into said coaxially aligned second holes for retaining each said latching arm within said housing when said first and second housing halves ae being locked together, and each said latching arm enabling said housing to be latched to said another housing.

2. A housing for holding an electrical connector so that said connector and said housing may mate and latch with another connector in another housing, said housing comprising:

first and second housing halves including means for receiving said connector, said first and said second housing halves each having a plurality of projections located inside at first predetermined positions inside and half, and a plurality of first and second holes;

said first holes of each of said halves being located at other predetermined positions for inserting and securely locking corresponding ones of said projections therein when said housing halves are mated together forming an assembled housing to hold said connector between said receiving means of said halves of said assembled housing, and said second holes being located at second predetermined positions; and, a number of latching arms, each latching arm having two opposed coaxial protrusions, each said arm positioned to be associated with a different pair of said second holes of said halves for inserting said protrusions therein to retain said latching arms within said assembled housing, each said latching arm having first and second detents for latching said arm to a cutout edge of a panel and to said another housing respectively.

3. The connector housing of claim 1 wherein each of said latching arms corresponds to a a first type of latching arm that comprises:

a first latching element for latching said first type of latching arm to a cutout edge of a panel, and a second latching element that permits said first type of latching arm to latch with said another housing.

4. The connector housing of claim 1, wherein each of said latching arms of said assembled housing corresponds to a second type of latching arm which comprises:

a third latching element for latching said second type of latching arm to said another connector housing, and means for resiliently opposing the movement of said second type of latching arm in one direction, and permitting a force to be applied to said second type of latching arm in said one direction to unlatch it from said another connector housing.

5. The connector housing of claim 4 wherein said plurality of projections are molded as part of each half and wherein each of said first holes has small and large diameter portions, each of said projections comprising:

a cylindrical shaped first part having first and second ends, said first end being affixed to said half, and a generally bulbous second part formed at said second end of said first part, said first part and said second part of each of said projections having a slot which divides said parts in half into two portions, the diameter of said second part being greater than the diameter of said small diameter portion of each first hole, said first and said second housing halves when assembled together causing each projection to enter said each first hole, said two portions of said bulbous second part of each projection being deformed inward toward said slot as said second part passes through said small diameter portion of said each first hole and said bulbous second part returning to its original shape after passing into said large diameter portion of said each first hole and locking said housing halves securely together.

6. The connector housing of claim 5 wherein a cable enters said assembled connector housing to be connected to said connector held therein, and further comprising:

a cable strain relief to hold said cable.

7. The connector housing of claim 6 wherein said first and said second housing halves are identical and each has a depression therein located opposite to each other inside said assembled connector housing to receive and securely hold said cable strain relief when said housing is assembled.

8. The connector housing of claim 1 wherein said plurality of projections are molded as part of each of said housing halves and each of said first holes has small and large diameter portions, each of said plurality of projections comprising:

a cylindrical shaped first part having first and second ends, said first end being affixed to said half, and a generally bulbous second part that is formed at said second end of said first part, said first part and said second part of each of said projections having a slot which divides said parts in half into two portions, the diameter of said second part being greater than the diameter of the small diameter portion of said first hole, said first and said second housing halves when assembled together causing each projection to enter into said each first hole, said two portions of said bulbous second part of each projection being deformed inward toward said slot as said second part passes through said smaller diameter portion of said each first hole and said bulbous second part returning to its original shape after passing into said larger diameter portion of said each first hole locking said housing halves securely together.

9. The connector housing of claim 8 wherein each of said latching arms assembled therein corresponds to a first latching arm that comprises:

a first latching element for latching said first latching arm onto the edge of a cutout in a panel thereby latching said connector housing to said panel; and, a second latching element for latching said first latching arm to said another housing.

10. The connector housing of claim 8, wherein each of said latching arms of an assembled housing corresponds to a second type of latching arm which comprises:

a third latching element for latching said second type of latching arm to said another connector housing, and means for resiliently opposing the movement of said second type of latching arm in one direction, and permitting a force to be applied to said second type of latching arm in said one direction to unlatch it from said another connector housing.

* * * * *